United States Patent [19]

Porch et al.

[11] 3,966,285

[45] June 29, 1976

[54] COLLAPSIBLE SHIPPING CONTAINER

[76] Inventors: Don E. Porch, 5026 E. Earl, Phoenix, Ariz. 85018; Paul W. Manktelow, 8310 E. Lewis, Scottsdale, Ariz. 85257; James E. Utz, 6608 S. 43rd Place, Phoenix, Ariz. 85040

[22] Filed: July 17, 1974

[21] Appl. No.: 489,446

[52] U.S. Cl. ..... 312/257 R; 312/257 SK; 312/263; 220/4 F

[51] Int. Cl.[2] ..... A47B 43/00; B65D 7/00

[58] Field of Search ... 312/257 R, 257 SK, 257 SM, 312/263, 257 A; 220/4 F, 84

[56] References Cited

UNITED STATES PATENTS

| | | | |
|---|---|---|---|
| 2,265,618 | 12/1941 | Adams | 220/4 F |
| 2,497,453 | 2/1950 | Hazen | 312/263 |
| 2,601,634 | 6/1952 | Rivette | 312/257 R |
| 2,710,784 | 6/1955 | Morin | 312/257 SK |
| 2,730,421 | 1/1956 | Burst et al. | 312/257 A |
| 2,806,755 | 9/1957 | Glass | 312/257 SK |
| 2,956,705 | 10/1960 | Clingman | 312/257 SK |
| 2,990,229 | 6/1961 | Engelbrecht | 312/257 SK |
| 2,991,140 | 7/1961 | Anderson et al. | 312/257 SK |
| 3,044,656 | 7/1962 | Combs et al. | 312/257 SK |
| 3,087,768 | 4/1963 | Anderson et al. | 312/257 SK |
| 3,087,768 | 4/1963 | Anderson et al. | 312/257 SK |
| 3,182,846 | 5/1965 | Kaff | 312/257 SK |
| 3,809,278 | 5/1974 | Csumrik | 220/4 F |

FOREIGN PATENTS OR APPLICATIONS

| | | | |
|---|---|---|---|
| 1,590,062 | 4/1970 | Germany | 312/257 A |
| 623,118 | 7/1961 | Italy | 220/84 |
| 581,810 | 9/1958 | Italy | 312/257 SK |
| 594,221 | 11/1947 | United Kingdom | 220/4 F |
| 694,263 | 7/1953 | United Kingdom | 312/257 SK |
| 695,180 | 8/1953 | United Kingdom | 312/257 SK |
| 884,273 | 12/1961 | United Kingdom | 312/257 SK |

*Primary Examiner*—Paul R. Gilliam
*Assistant Examiner*—Victor N. Sakran

[57] ABSTRACT

The disclosure relates to a collapsible shipping container adapted for use in shipping various cargo on trucks or by rail or by means of aircraft or any other suitable transport means such as sea going vessels or the like. The container being provided with six side structures removably connected together so as to permit compact shipping of the containers in disassembled condition to reduce the bulk thereof so that they may be transported from one area to another returned to the point of origin for reuse. The containers being provided with disengageable fixture means for holding the respective panels together which fixture means is readily operable to disassemble the panel structures of the container so as to open the same for the placement of cargo therein or for the removal of cargo therefrom. The container being provided with fixture means on the inside thereof accessible from the inside only and with a locked door in one of the panels to provide authorized access to the removable fixtures on the inside of the container so as to permit disassembly thereof or opening the container to remove cargo therefrom. The structure of the container comprises tubular frame members having a pair of flanges disposed at substantially right angles to each other and socket portions in the ends of the tube members with prong structures connected to the corners of at least two of the panel structures such that the prongs may fit into open ends of the frame members of some of the panel structures to interlock the entire assembly when the removable fixture means is projected through the flanges of the frame members and fastened relative thereto.

2 Claims, 14 Drawing Figures

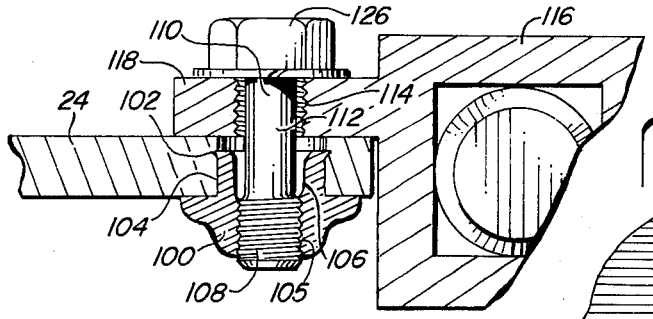
FIG-12
FIG-9
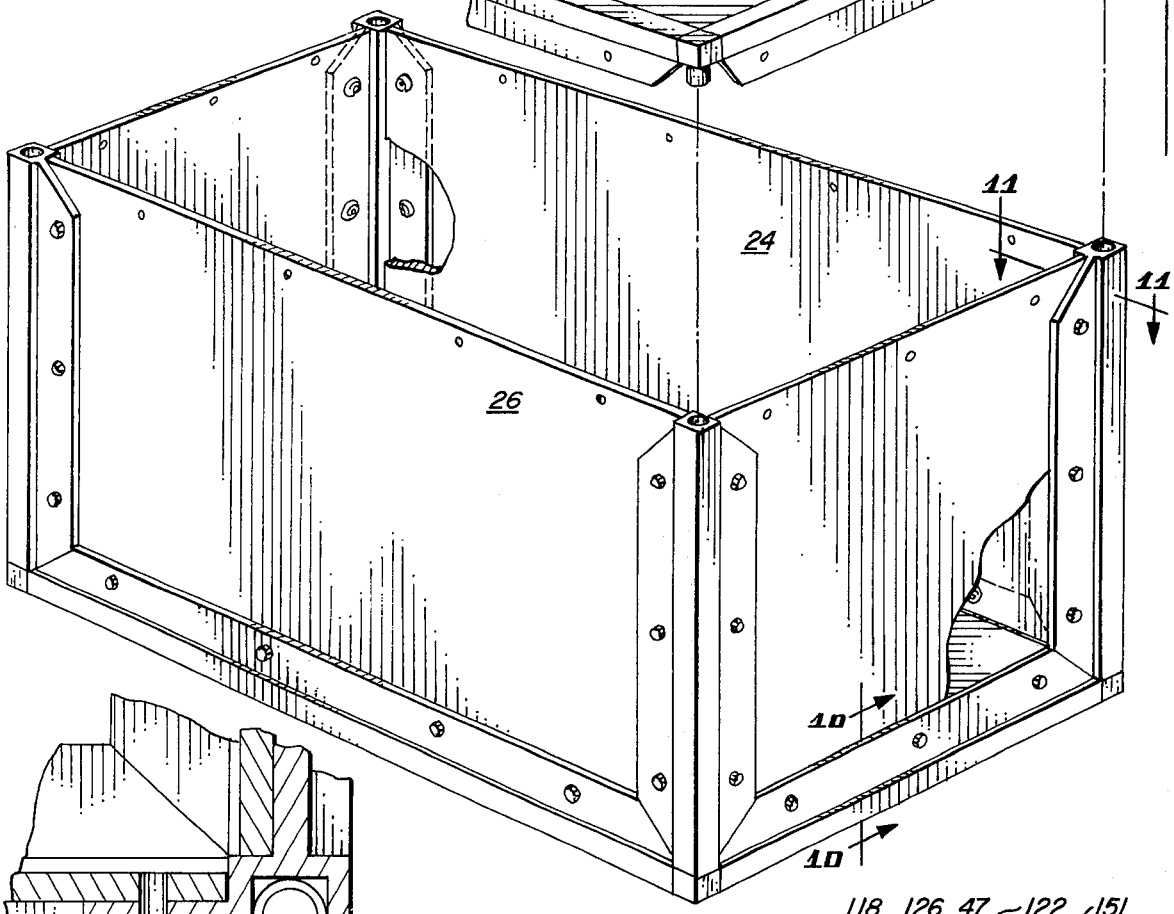
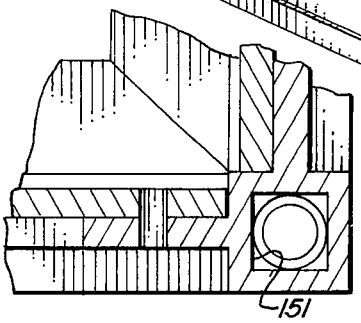
FIG-10
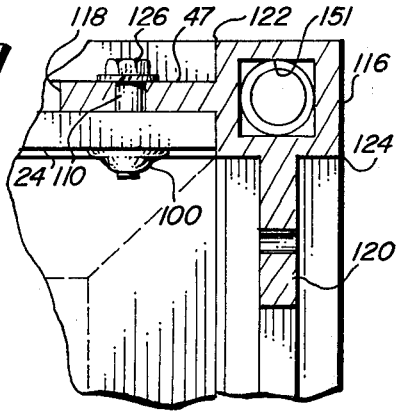
FIG-11
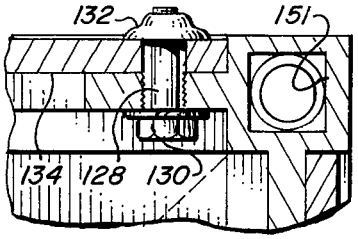
FIG-13
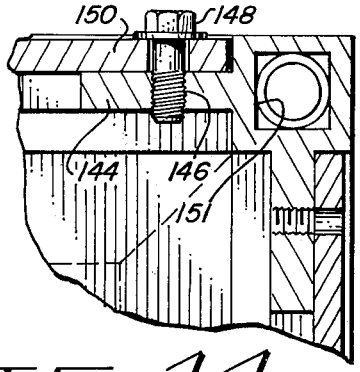
FIG-14

COLLAPSIBLE SHIPPING CONTAINER

BACKGROUND OF THE INVENTION

Many shipping containers have been utilized for transporting cargo from one place to another, a typical example being the usual box trailers mounted on wheels and which are rented to persons desiring to tow them from one place to another for carrying cargo therein. Other shipping containers have been used aboard railway transport vehicles, aircraft, ocean going boats and other vehicles for use in transporting cargo; however, most of such containers have either been bulky to handle and return to the point of origin or have been expendable containers all of which is an expensive manner of shipping cargo. The usual box type trailers or van type trucks do not have collapsible containers but are provided with thick box-like structures which are very bulky and if transported to a point of origin or to a location for reuse, the bulk of the container is prohibitive in that only a small number may be transported on a railway flat car for example. Accordingly, prior art shipping containers have either been too bulky to transport in large numbers on a given carrier for the purpose of returning such containers to the point of origin or for reuse when not loaded and consequently, the economy of using shipping containers has suffered from the bulk of the containers when not loaded and when it is necessary to transport such containers without any payload therein. Consequently, many prior art containers have been designed so that they are expandable; however, this is a costly manner of shipping cargo.

SUMMARY OF THE INVENTION

The present invention comprises a collapsible shipping container having at least six wall panel structures which are removably connected together to form a complete box-like enclosure and may be used for shipping cargo therein when enclosed and may be returned to the point of origin or to a use location in collapsed condition. The containers having removable fixture means which allow the wall panel structures to be all disconnected so that such panels may be stacked in flat position relative to each other so that they take only a small fraction of the space that the container does when it is carrying cargo. Accordingly, the present invention provides for economy of shipping containers in that these containers are collapsible and economically transportable to the point of origin or to new use locations. The structure of the collapsible shipping container of the present invention comprises individual wall panel structures comprising top, bottom, sides and ends involving at least six wall panel structures and at least two of the panel structures are provided with projecting prongs at the corners thereof which fit into open sockets in the ends of tubular or hollow frame elements of at least four of the panels thereby effectively interlocking the corner frame structures of all the panels when the removable fixture means of the container structure is securely fastened to flanges of the frame elements at the corners or edges of the wall panel structures of the invention. The invention comprises corner joint members having three prongs all projecting at right angles to each other and tubular frame elements having open ends into which the prongs are fitted, the frame elements having flanges extending laterally therefrom and at substantially right angles to each other. Flat panel members are secured to the flanges and at least two of the wall panels are provided with said joint members so arranged at the corners of the panels that at least one prong of each joint member extends substantially at right angles to the panel and is disposable in open ends of similar tubular frame members at corners of the collapsible container which parallel to the prongs of the joint members.

The collapsible shipping container of the invention is also provided with an access door in one of the panels thereof, the access door being provided with a lock and adapted to be unlocked to provide access to removable fixture means which are on the inside of the container thus to prevent unauthorized opening of the container and to thereby insure safe shipment of a cargo therein.

The invention comprises captive fixture means on some of the panel structures which are cooperable with second fixture means on the frame flanges of other of the panel structures so that the fixtures means adapted to hold panels together do not become lost or displaced from the panel structures.

Additionally, the parts of the collapsible shipping container of the invention may be standardized such that various side or wall panels may be exchanged from one container to another in case a wall or side or top panel becomes damaged thus the universal use of the parts allows the collapsed shipping container to be quickly reconstructed by a simple addition of another standard wall, top, bottom or end panel structure. In this manner various parts of one damaged container may be used to replace comparable parts of another damaged container.

Accordingly, it is an object of the invention to provide a collapsible shipping container which is very economical for use in shipping cargo on trucks, trailers, railway cars, aircraft or ocean going vessels due to the fact that the containers when unloaded may be completely collapsed and stacked in a very compact disposition thus allowing shipping density of the collapsed containers for return to the point of origin or a new use location whereupon the containers may again be reassembled into a box-like configuration for containing cargo to be shipped.

Another object of the invention is to provide a collapsible shipping container having novel frame and panel structure provided with interlocking joint members having three prongs fitted into open socket like ends of tubular frame members which are provided with flanges carrying flat panel members secured thereto and wherein removable fixtures are utilized to removably connect at least two panels to respective flanges of the frame structures of the collapsible shipping container.

Another object of the invention is to provide a collapsible shipping container having a variety of removable fixture means which may readily be used to assemble and disassemble the six panel structures of the shipping container.

Another object of the invention is to provide a collapsible shipping container which may contain a pleurality of individual panels adapted to be readily and removably interlocked or disassembled by simple disengageable fixture means to allow the construction of very rugged and durable enclosures for shipping goods and for allowing the dismanteling of the containers into flat panels which may be stacked in a very neat configuration to allow for shipping density of the containers in such collapsed condition to a point of origin or to a new use location.

Further objects and advantages of the invention may be apparent from the following specifications, appended claims and accompanying drawings.

BRIEF DESCRIPTION OF THE DRAWINGS

FIG. 9 is a view similar to FIG. 1 but showing a modification of the invention;

FIG. 10 is an enlarged fragmentary sectional view taken from line 10—10 of FIG. 9;

FIG. 11 is an enlarged fragmentary plan sectional view taken from line 11—11 of FIG. 9;

FIG. 12 is an enlarged plan sectional view of the structure shown in FIG. 11 showing the section through a removable fixture means of the invention;

FIG. 13 is a plan sectional view similar to FIG. 11 but showing the removable fixture means of the invention accessible from the inside of the container of the invention; and FIG. 14 is a further plan sectional view similar to FIG. 11 but showing a further modified form of the removable fixture means adapted for connecting the various panel structures of the container together.

DESCRIPTION OF THE PREFERRED EMBODIMENTS

Figure 1:
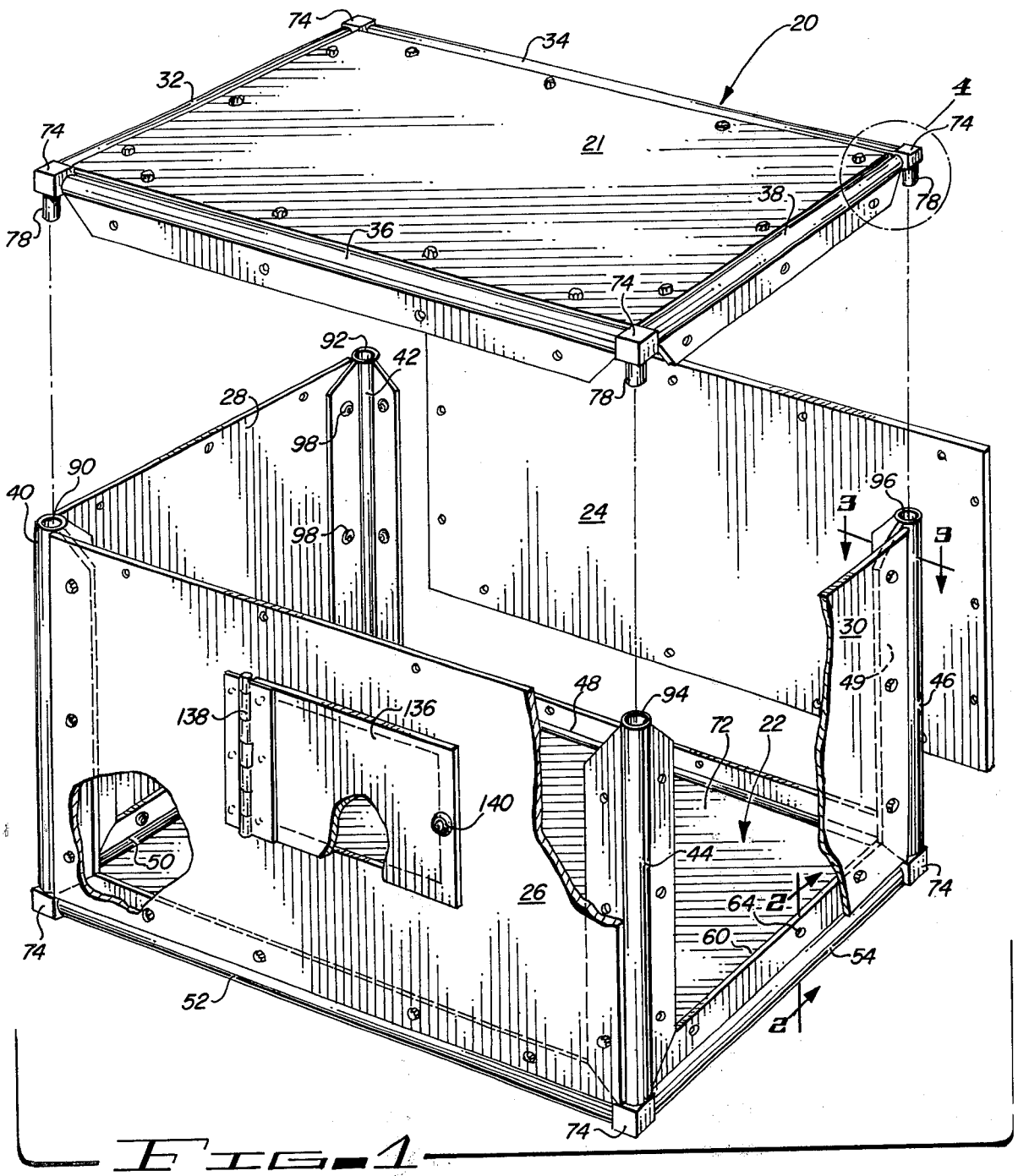
FIG. 1 is a perspective view of a collapsible shipping container in accordance with the present invention showing the cover in removed position and one wall panel displaced from the flanges of the frame as well as the complete omission of another panel so as to expose details of the invention and further showing portions fragmentarily to amplify the illustration.

The collapsible shipping container of the invention is provided with a top 20, a bottom 22, a pair of opposite sides 24 and 26 and a second pair of opposite sides 28 and 30.

Although the sides, top and bottom are so defined, these sides, top or bottom may be utilized to support the container in various positions, upside down or otherwise due to the structural rigidity of the overall container as will hereinafter be described.

The top 20 is provided with a central panel structure 21 which may be of plywood or other suitable rigid material. This panel 21 is surrounded by frame members 32, 34, 36 and 38 and similar frame members 40, 42, 44 and 46 are disposed in the vertical corners of the container between the respective sides 24, 26, 28 and 30. The bottom 22 is provided with outlined frame members 48, 50, 52 and 54 and all of these frame members are of substantially the same cross section as shown best in FIG. 2 of the drawings wherein the frame member 54 is illustrated and this frame member is provided with a hollow structure having a bore 56 within a generally circular tubular cross section 58 and integral with this cross sectional structure 58 is a flange 60 which is provided with opening 64 therein adapted to receive fixtures for holding the end wall panel 30 in connection with the flange 60.

Figure 2:
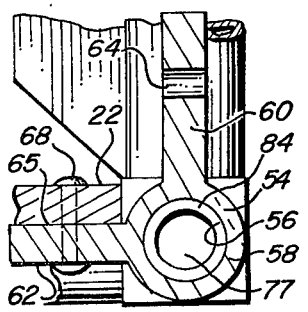
FIG. 2 is an enlarged fragmentary sectional view taken line 2—2 of FIG. 1.
Figure 3:
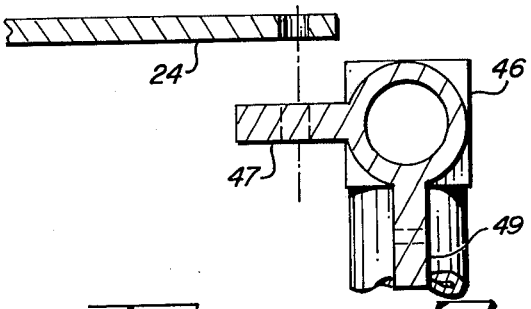
FIG. 3 is an enlarged plan sectional view showing an exploded relation of the panel and frame structures of the container.

Integral with the tubular section 58 as shown in FIG. 2 is another flange 62 extending at right angles to the flange 60 and this flange 62 is provided with openings similar to the opening 64 through which rivets 68 extend and secure the bottom panel 22 to the flange 62.

The cross section of the frame member 58 is typical of that of all of the frame members surrounding the various top, bottom and side wall structures of the container of the invention.

Figure 6:
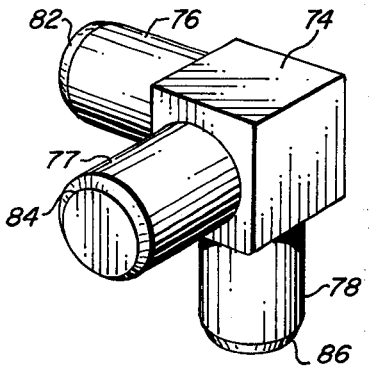
FIG. 6 is a perspective view of an intersecting joint member of the invention.

Intersecting adjacent ends of the various frame members and connecting these frame members together are three prong joint members as shown best in FIG. 6 of the drawings. Each joint member being designated 74 and provided with a pair of prongs 76 and 77 disposed at right angles to each other and on a common plane and also integral with the joint member 74 is another prong 78 extending at right angles to the planes or axis of the prongs 76 and 77.

The prongs 76 and 77 are provided with Chamfered or tapered ends 82 and 84 respectively and the prong 78 is provided with a tapered end 86 all of which tapered ends facilitate the insertion of the prongs into open ends of the bore portions of the frame members. Attention being called to FIG. 2 of the drawings showing the prong 77 with its respective tapered end portion 84 within the bore 56 of the frame member 54.

The joint members 74 which interconnect the frame members 32, 34, 36 and 38 of the top 20 are disposed with their prongs 76 and 78 in open ends of the bore portions of the respective frame members at the corners of the top and each respective prong 78 is directed downwardly and adapted to fit into respective open ends 90, 92, 94 and 96 of the frame members 40, 42, 44 and 46. Correspondingly the joint members 74 in connection with the frame members 48, 50, 52 and 54 of the bottom 22 have their prongs 78 extending upwardly into lower open ends of the frame members 40, 42, 44 and 46 all as shown best in FIG. 1 of the drawings.

Figure 7:
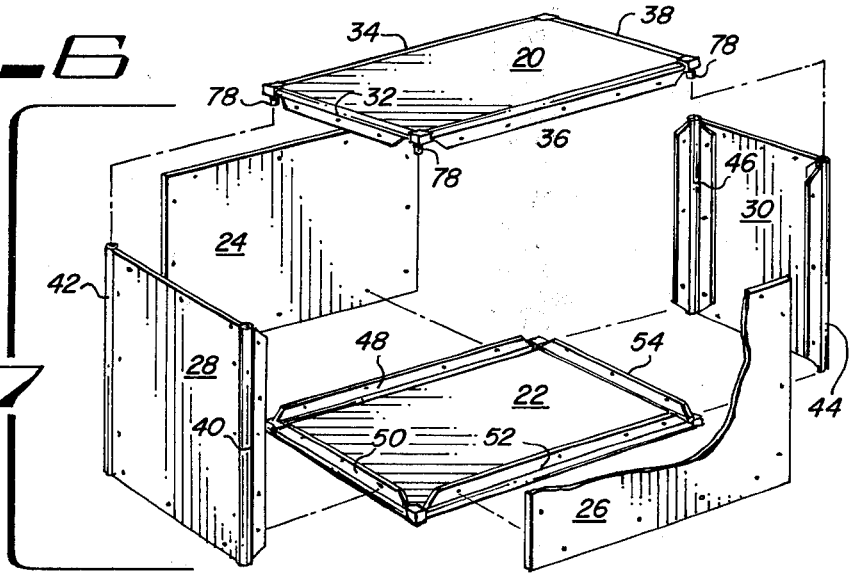
FIG. 7 is an exploded view of the collapsible container of the invention shown with all six panel structures removed from each other but generally in a position related to the assembly thereof.

As shown in FIG. 7 of the drawings, the top 20 with its panel 21 may be secured to respective flanges of the frame members 32, 34, 36 and 38 by means such as the rivet 68 shown in FIG. 2 so that the top 21 is a unitary structure containing the frame members and joint members as hereinbefore described. Additionally, it will be seen that the opposite sides 28 and 30 are also constructed such that the plywood panels or other structures are riveted or otherwise fixed to the respective upright frame members, the panel 28 being secured to the frame members 40 and 42 while the panel 30 is secured to the frame members 44 and 46 and thus the bottom 22 is also constructed so that only the opposite side panels 24 and 26 are removably connected to the various flanges of the frame members of the container and these opposite side panels 24 and 26 are removably connected to the flanges of the vertical frame members as will be hereinafter described in connection with the disclosure of FIGS. 11, 12, 13 and 14.

Figure 4:
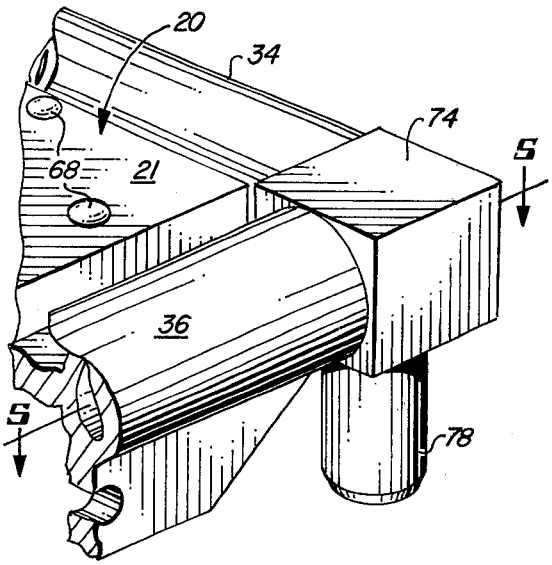
FIG. 4 is an enlarged fragmentary perspective view of an area of the structure shown in FIG. 4 and surrounded by a broken line designated 4.
Figure 5:
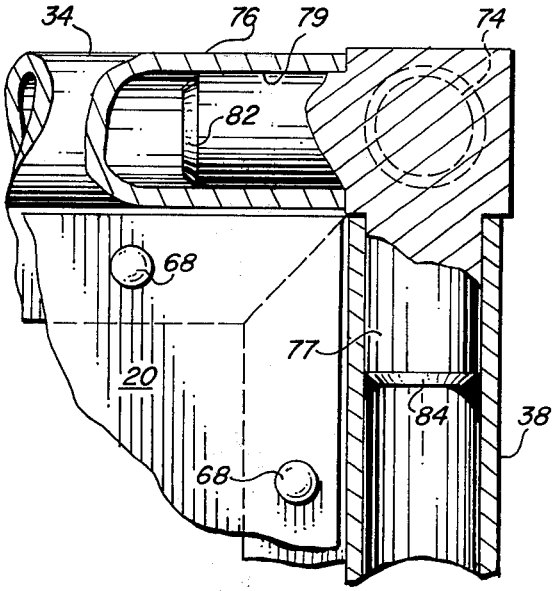
FIG. 5 is a fragmentary plan sectional view taken from the line 5—5 of FIG. 4.

The assembly of the collapsible shipping container of the invention is shown in FIG. 1 of the drawings with the top removed and in FIG. 7 in an exploded view as hereinbefore described and the prongs 76, 77 and 78 are extended into open ends of the various frame members as hereinbefore described, particular reference being made to FIG. 5 in which one corner of the top 20 is shown in section and wherein one of the joint members 74 has one of its prongs 76 disposed in a bore portion 79 of the frame member 34 wherein the prong 77 extends into a bore 80 of the frame member 38 and in FIGS. 4 and 5 the rivets 68 are shown securely holding the plywood panel structure 21 to the respective flanges of the frame members 34 and 38. Accordingly, it will be understood that at the corners of the container the prongs on the joint members 74 interlock into the open ends of the bore portions of the frame members for holding the container rigidly together when the removable fixtures are secured relative to the opposite side wall panels 24 and 26 and the respective frame member flanges of the opposite sides and the top and the bottom all as will be hereinafter described in detail.

As shown in FIGS. 11 and 12 of the drawings, fasteners which hold the side panels 24 and 26 to the frame flanges comprise first and second disengageable means comprising an internally screw threaded nut 100 secured to the inside of the side panel 24, this nut 100 is provided with an annular upset flange 102 secured into a bore 104 in the panel 24 and the nut 100 is provided with an internally screw threaded bore 105 and a counter bore 106 which is equal to the major diameter of the threaded portion 105 so that external screw threads 108 on the bolt 110 may clear and pass through the bore 106 for disengagement as will be hereinafter described. The bolt 110 is provided with a shank 112 which is equal to the minor diameter of the thread 105 and is slideable through internal screw threads 114 in a flange 118 of a frame member 116.

The flange 118 corresponding with one of the flanges 60 or 62 as shown in FIG. 2 of the drawings, the flange 118 having internal screw threads 114 similar to the threads 105 and thus capable of holding the threaded portion 108 captive when retracted into the bore 106 of the fixture 100 and when the screw threaded portion of the bolt 110 is released by applying a wrench to the hexhead 126 of the bolt 110 the screw threads 108 are backed out of the threads 105 in the fixture 100 into the bore 106 thereby releasing the panel 24 from the flange 118. However, the threads 108 are retained inwardly of the threads 114 in the flange 118 and the bolt must be consciously screw threadably removed through the threads 114 and thus the bolt 110 is prevented from displacement relative to the flange 118. In this manner the panels 24 and 26 are removably connected to the respective flanges of the frame members and it will be seen that while the hexhead 126 is on the outside of the container as shown in FIG. 12, it may be on the inside of the container as shown in FIG. 13, the head being designated 130 in FIG. 13 and the fixture being designated 132, the fixture 132 in FIG. 13 corresponding to the fixture 100 shown in FIG. 12.

This provides a blind fastener for securing the panels 24 and 26 and requires an access door in one of the panels such as the door 136 shown in FIG. 1 of the drawings and in the side of the panel 26.

This door 136 is provided with a piano hinge 138 and a lock 140 so as to lock the door and close access to the interior of the container as well as to the hexheads 130 of the bolts 128. In this manner, the door may be opened by unlocking the tumbler lock with a key and allowing a person to reach inside the container with a wrench and to engage the hexheads 130 as shown in FIG. 13 to release the screw threaded structure of the bolt 128 from the fixture 130 in a similar manner to that described in FIG. 12 of the drawings with the bolt 110 of the fixture 100.

It will be seen that the disclosure FIG. 13 applies to the disclosure of FIG. 1 of the drawings in that the panels are on the outsides of the frame member flanges and as shown in FIG. 9 of the drawings the side panels 24 and 26 may be on the insides of the flanges and secured in a manner as shown in FIG. 11 where the fixture 100 is on the inside and the hexhead 126 of the bolt 110 is on the outside.

One modification of the invention as shown in FIG. 14 comprises a frame member 142 having a flange 144 with an internally screw threaded bore 146 engaged by an externally screw threaded portion a bolt 148 which secures a panel 150 to the frame member 142. This corresponds with the securing of one of the panels 24 or 26 to a corresponding flange of one of the frame members as shown in FIG. 1 of the drawings.

As shown in FIGS. 10 to 14 inclusive, the frame members are generally rectangular in cross section with substantially rectangular bore portions 151 and this cross sectional shape is different from that as shown in FIG. 2 for example wherein the bore portion 58 is circular.

Figure 8:
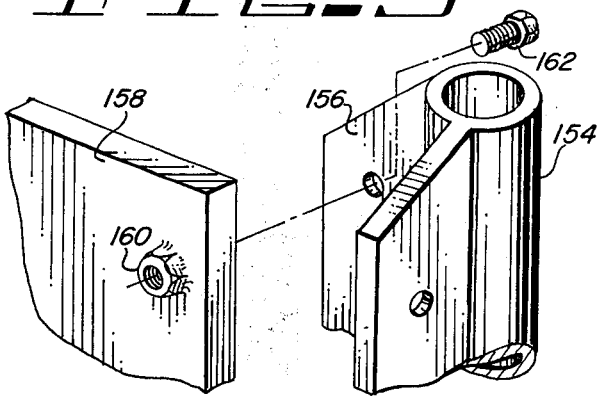
FIG. 8 is an exploded view showing removable fixture means of the invention as it is related to tubular frame elements and panel structures of the invention.

Another modification of the removable fixture means may be seen in FIG. 8 of the drawings wherein a frame member 154 is provided with a flange 156 adjacent to which a panel 158 may be secured. The panel 158 may be of material to which a nut 160 may be fused and this nut 160 receives a screw threaded bolt 162 which passes through an opening 164 in the flange 156.

It will be obvious that various removable fixtures may be used to secure the panel sides 24 and 26 to the respective flanges of the frame members for allowing complete disassembly of the collapsible container of the invention so that all of the sides as well as the top and bottom may be flat structures which may be stacked together to thereby afford compact shipping of these collapsed containers when they are not carrying a cargo.

Such collapsed condition of the container has a great advantage in that the container may be shipped with a cargo and then when the cargo arrives in the container, the removable fixtures such as those shown in FIGS. 11 to 14 of the drawings may be removed by applying a pneumatic speed wrench or electrical speed wrench to the hexheads of the fixtures for quickly backing them out and releasing the side panel structures 24 and 26 and thus allowing complete disassembly of the container. First of all, the removable fixtures connecting the panels 24 and 26 with the top 20 may be removed. These fixtures also being disposed in the upper edges of the opposite side panels 28 and 30 and thus the top 20 may be removed from the container first for unloading the cargo therefrom whereupon the container may subsequently be collapsed into very compact form.

When collapsed into compact form, the various sides, top and bottom may be stacked in a compact stack and shipped on a railroad car or a flatbed truck to a point of shipping origin. It will be understood that the compact collapsed condition of the containers of the invention may afford great economy in the use of shipping containers as compared to the conventional fixed bodies of rental trucks and/or trailers which can only be shipped empty in very bulky box-like condition.

It will be understood that the top 20 and bottom 22 may be molded structures having the respective prongs 78 projecting downwardly at the corners and engageably in open ends of bore portions in the sides 28 and 30 which may also be molded as a unitary structure so that the top 20, the bottom 22 and the sides 28 and 30 may be all molded of some material such as polypropelline or other suitable material, and the opposite side panels 24 and 26 may be removably connected by the various removable fixture means disclosed herein and in this manner the outlined frame structures may be molded integral with the top 20, the bottom 22 and the opposite side structures 28 and 30.

It will be obvious to those skilled in the art that various modifications may be resorted to without departing from the spirit of the invention.

We claim:

1. A collapsible and reusable shipping container which, in total, is too large for manual handling; said container comprising a box-like structure having corners, said box-like structure provided with a first pair of side structures; a top; and a bottom; said container adapted to rest on any one of said side, top or bottom structures; said side, top and bottom structures all having opposite edges; elongated tubular frame members each having open opposite ends and disposed at all of said edges; joint members disposed at said corners, and said frame members all intersecting said joint members at said corners; each of said joint members having three prongs, each of said prongs disposed in one of said open ends of said hollow tubular frame members; each hollow tubular frame member having a longitudinal axis and having a pair of flat elongated longitudinal flanges; each pair of flanges being parallel with said longitudinal axis of a respective frame member; each of said flanges extending laterally from each respective hollow tubular frame member; the flanges of each of said pairs being spaced angularly apart; each flange having a plurality of first disengageable fixture means spaced longitudinally thereof; at least two of said sides, top or bottom structures having a panel member overlapping at least four of said flanges of four respective frame members; and second disengageable means cooperative with each of said first disengageable means for removeably holding said panels fixed on respective frame members, each of said prongs readily slidably removed from each respective one of said open ends when respective disengageable means is disengaged; said disengageable fixture means being accessable from the interior only of said box-like structure; one of said panels having a locking door means, adapted to provide manual access to said disengageable fixture means; all of said panels readily disconnectable from each other so that all of said panels may be separate for easy handling and shipping exchange replacement relative to each other; said container being collapsible and having at least six panels removeably connected together; fixture means removeably connecting said panels in an enclosing assembly; all six of said panels readily disconnedctable from each other so that all of said panels may be separate for easy manual handling and shipping exchange replacement; said fixtures accessible only from inside said container; at least one of said panels having a locking door means to provide access to said removeable fixture means internally of said container.

2. The invention as defined in claim 1, wherein: said container is provided with at least six enclosing panels, a first pair of said panels having generally flat opposite sides and also having a pair of opposite edge structures provided with opposite ends; each opposite end having a prong receiving socket therein; a second pair of said panels having substantially flat opposite sides and also having four corners, each of said four corners provided with an elongated prong fitted into one of said sockets; each of said prongs having a longitudinal axis projecting at substantially right angles to the respective panels; each of said panels having surrounding edges; a third pair of said panels; at least four of said panels each having a pair of flanges; said flanges overlapping adjacent surrounding edges of said third pair of panels and disengageable fixture means removeably connecting said flanges with said adjacent surrounding edges of said third pair of panels; each of said prongs readily slidably removeable from each respective socket when respective disengageable fixture means is disengaged; said fixture means being accessable only from the interior of said box-like structure; one of said panels having a locking door means adapted to provide manual access to said fixture means; all six of said panels readily manually disconnectable from each other so that all of said panels may be separate for easy handling and shipping exchange replacements relative to each other.

* * * * *